US011439181B2

(12) United States Patent
Liu et al.

(10) Patent No.: US 11,439,181 B2
(45) Date of Patent: Sep. 13, 2022

(54) ATOMIZER

(71) Applicant: Hunan Jiayeda Electronic., Ltd, Changde (CN)

(72) Inventors: Zhiqian Liu, Changde (CN); Xiaoluo Shi, Changde (CN); Wenchou Fan, Changde (CN); Long He, Changde (CN); Zongyu Liu, Changde (CN); Pucha Chen, Changde (CN)

(73) Assignee: Hunan Jiayeda Electronic., Ltd, Changde (CN)

( * ) Notice: Subject to any disclaimer, the term of this patent is extended or adjusted under 35 U.S.C. 154(b) by 334 days.

(21) Appl. No.: 16/858,406

(22) Filed: Apr. 24, 2020

(65) Prior Publication Data

US 2020/0253282 A1 Aug. 13, 2020

(30) Foreign Application Priority Data

Mar. 5, 2020 (CN) ..... 202010149068.1

(51) Int. Cl.
*A24F 40/05* (2020.01)
*A24F 40/42* (2020.01)
*A24F 40/46* (2020.01)

(52) U.S. Cl.
CPC ..... *A24F 40/05* (2020.01); *A24F 40/42* (2020.01); *A24F 40/46* (2020.01)

(58) Field of Classification Search
None
See application file for complete search history.

(56) References Cited

U.S. PATENT DOCUMENTS

2018/0325169 A1* 11/2018 Guo ..... A24F 40/44
2020/0214349 A1* 7/2020 Liu ..... A24F 40/44
2020/0253282 A1* 8/2020 Liu ..... A24F 40/46
2021/0077751 A1* 3/2021 Hua ..... B05B 17/0646
2021/0378303 A1* 12/2021 Liu ..... A24F 40/42

* cited by examiner

*Primary Examiner* — James Harvey

(57) ABSTRACT

An atomizer includes a liquid storage shell, an ultrasonic atomizing core, a liquid transporting cotton, a cooling block, and an end cap. The liquid storage shell surrounds the liquid storage cavity and the functional cavity which are isolated from each other, wherein the liquid storage cavity is used for storing liquid. The ultrasonic atomizing core is assembled in the functional cavity. The liquid transporting cotton is connected to the ultrasonic atomizing core and inserted into the liquid storage cavity, so as to transport the liquid in the liquid storage cavity to the ultrasonic atomizing core. The cooling block is attached on one side of the ultrasonic atomizing core. The cooling block has an atomizing hole and an oil return hole. The end cap is connected to one end of the liquid storage shell to seal the liquid storage cavity and the functional cavity.

10 Claims, 5 Drawing Sheets

ATOMIZER

CROSS REFERENCE OF RELATED APPLICATION

The present invention claims priority under 35 U.S.C. 119(a-d) to CN 202010149068.1, filed Mar. 6, 2020.

BACKGROUND OF THE PRESENT INVENTION

Field of Invention

The present invention relates to atomizer technical field, and more particularly to an atomizer.

Description of Related Arts

The ultrasonic atomizer can atomize the liquid by high-frequency oscillation of the ultrasonic atomizing core, and then the liquid can be diffused into the air, thereby increasing the diffusion area of the liquid. However, the ultrasonic atomizing core generates heat during working. The temperature of the ultrasonic atomizing core will gradually increase after the heat is gradually accumulated, and after the temperature is increased, the liquid component will decompose and lose its effectiveness. Furthermore, the life of the ultrasonic atomizing core will also be reduced.

Therefore, there is an urgent need to improve the structure of the ultrasonic atomizer, so as to reduce the temperature of the ultrasonic atomizer during operation.

SUMMARY OF THE PRESENT INVENTION

In order to solve the above-mentioned technical problems, an object of the present invention is to provide an atomizer to avoid a relatively high temperature of an ultrasonic atomizing core during operation.

Accordingly, the present invention provides an atomizer, comprising:

- a liquid storage shell surrounding a liquid storage cavity and a functional cavity which are isolated from each other, wherein the liquid storage cavity is used for storing liquid;
- an ultrasonic atomizing core assembled in the functional cavity;
- a liquid transporting cotton connected to the ultrasonic atomizing core and inserted into the liquid storage cavity, so as to transport the liquid in the liquid storage cavity to the ultrasonic atomizing core;
- a cooling block attached on one side of the ultrasonic atomizing core, wherein the cooling block has an atomizing hole and an oil return hole; and
- an end cap connected to one end of the liquid storage shell to seal the liquid storage cavity and the functional cavity, wherein the end cap contacts with and fixes the cooling block, and the end cap has a mist hole;
- wherein the liquid is discharged through the atomizing hole and the mist hole in sequence after being atomized.

Preferably, a diameter of the atomizing hole is 1-5 mm.

Preferably, a side of the cooling block, which faces the ultrasonic atomizing core, has a limiting groove; the liquid transporting cotton is placed in the limiting groove and opposite ends of the liquid transporting cotton are inserted into the liquid storage cavity; the liquid cotton has a hollow area to avoid blocking the atomizing hole.

Preferably, a limiting rib is provided on an internal wall of the functional cavity, and a matching groove is provided on the cooling block; the cooling block contacts with the internal wall of the functional cavity, and the matching groove cooperates with the limiting rib; or a matching groove is provided on an internal wall of the functional cavity, and a limiting rib is provided on the cooling block; the cooling block contacts with the internal wall of the functional cavity, and the matching groove cooperates with the limiting rib.

Preferably, the atomizer further comprises: an insulating sleeve, a conductive rod, a conductive spring, and a thermally conductive silicone grease, wherein an end of the liquid storage shell, which is away from the end cap, has a conductive channel communicating with the functional cavity; the insulating sleeve is under an interference fit state in the conductive channel; the conductive rod passes through the insulating sleeve and is connected to the conductive spring, and the conductive spring is further connected to the ultrasonic atomizing core; the thermally conductive silicone grease is filled between the ultrasonic atomizing core and the conductive rod.

Preferably, the atomizer further comprises: a baffle, wherein the baffle is pressed between the end cap and the cooling block, and the baffle has a notch; an orthographic projection of the notch on the end cap does not overlap with the mist hole.

Preferably, the atomizer further comprises: an auxiliary shell assembly and a fan, wherein the liquid storage shell has a first air duct communicating with the functional cavity; the auxiliary shell assembly is connected to the liquid storage shell, and has a second air duct communicating with the first air duct; the fan is assembled in the auxiliary shell assembly and faces the second air duct, so as to accelerate air flow in the functional cavity.

Preferably, the atomizer further comprises: a circuit board, wherein the circuit board is assembled in the auxiliary shell assembly; the second air duct further extends to the circuit board, and the fan is electrically connected to the circuit board, so as to accelerate air flow around the circuit board.

Preferably, an end of the second air duct, which is away from the liquid storage shell, further penetrates the auxiliary shell assembly.

Preferably, the atomizer further comprises: a magnet, wherein the magnet is connected to the liquid storage shell and magnetically connected to the auxiliary shell assembly; or the magnet is connected to the auxiliary shell assembly and magnetically connected to the liquid storage shell.

Beneficial effects of the present invention:

The atomizer of the present invention comprises the liquid storage shell the ultrasonic atomizing core, the liquid transporting cotton, the cooling block, and the end cap. The liquid storage shell surrounds the liquid storage cavity and the functional cavity which are isolated from each other, wherein the liquid storage cavity is used for storing liquid, and the functional is used for assembling atomizing parts as well as recycling large particle droplets generated by atomization. The ultrasonic atomizing core is assembled in the functional cavity, which uses high-frequency vibration to break up the liquid molecular structure to produce a naturally flowing mist. The liquid transporting cotton is connected to the ultrasonic atomizing core and inserted into the liquid storage cavity, so as to transport the liquid in the liquid storage cavity to the ultrasonic atomizing core. The cooling block is attached on one side of the ultrasonic atomizing core. The cooling block has the atomizing hole and the oil return hole. After the liquid is atomized, it is blown out from the atomizing hole, and heat of the ultrasonic atomizing core is transported to the cooling block, thereby keeping the ultrasonic atomizing core at a suitable working temperature. The function chamber recovers the large particle droplets generated by atomization and returns them to the liquid transporting cotton through the oil return hole. The end cap is connected to one end of the liquid storage shell to seal the liquid storage cavity and the functional cavity. The end cap contacts with and fixes the cooling block to ensure contact tightness between the cooling block and the ultrasonic atomizing core. Furthermore, heat of the cooling block can be transferred to the end cap, and the end cap will diffuse the heat into the air, thereby accelerating the heat diffusion of the ultrasonic atomizing core.

BRIEF DESCRIPTION OF THE DRAWINGS

In order to more clearly explain the embodiments of the present invention or the technical solutions in the prior art, drawings recited in the embodiments or the description of the prior art will be briefly introduced as follows. Obviously, the drawings in the following description are only the embodiments described in the present invention. For those of ordinary skill in the art, other drawings can be obtained based on these drawings without paying any creative work.

DETAILED DESCRIPTION OF THE PREFERRED EMBODIMENT

In order to enable those skilled in the art to better understand the technical solutions, the present invention will be described in detail below with reference to the accompanying drawings. The description in this section is only exemplary and explanatory, and should not limit the protection scope of the present invention.

Figure 1:
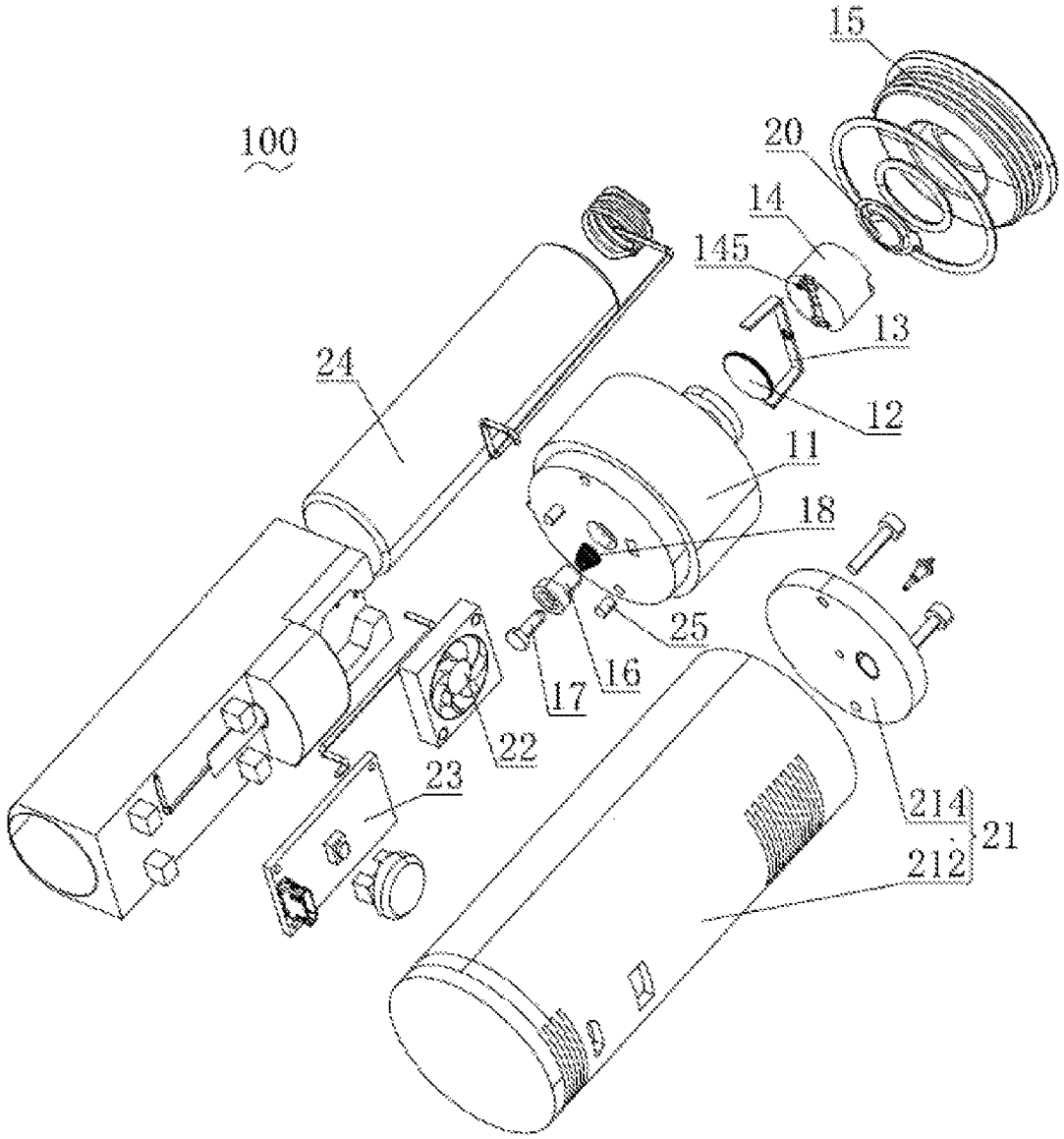
FIG. 1 is an exploded view of an atomizer of the present invention.
Figure 2:
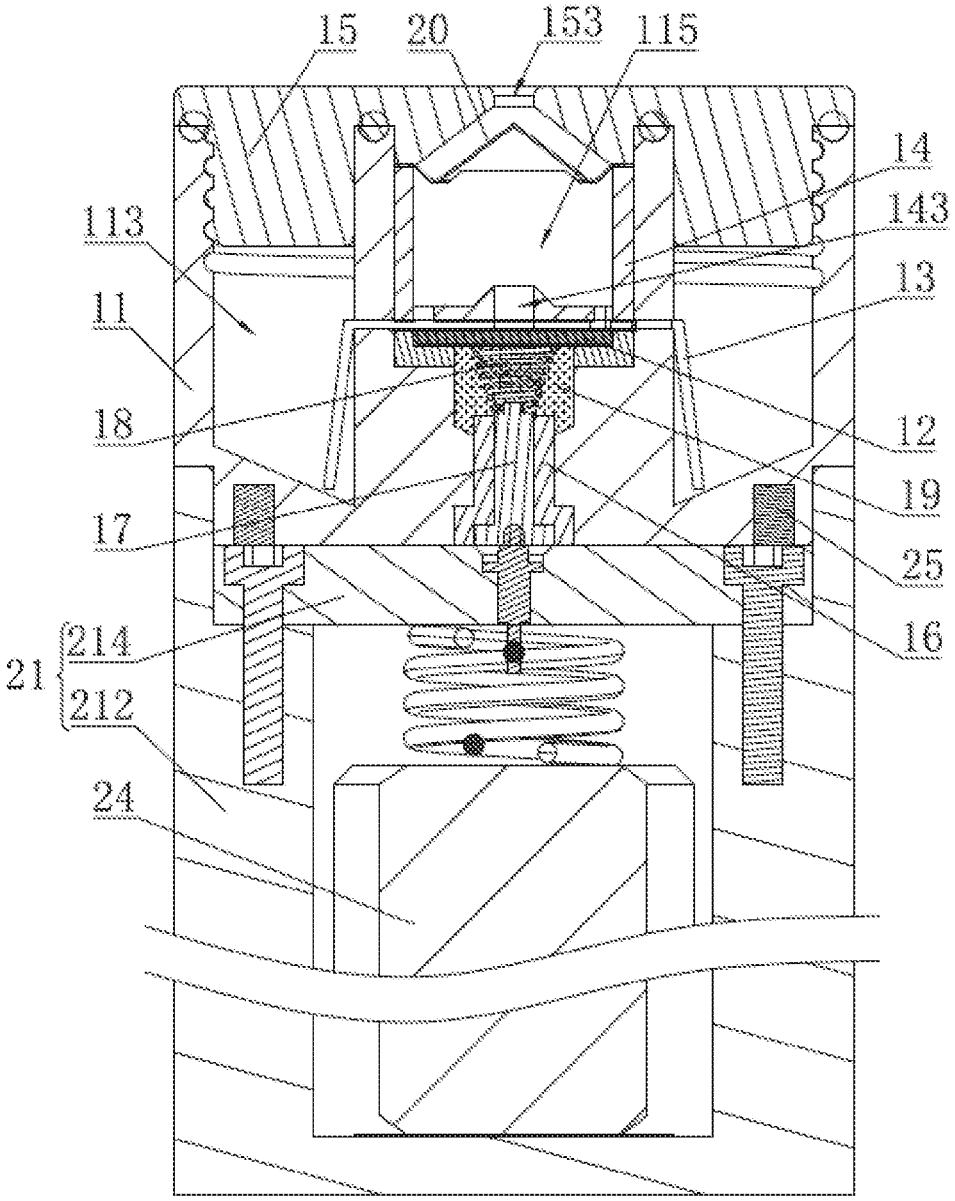
FIG. 2 is a cross-sectional view of the atomizer of the present invention from a first perspective.
Figure 3:
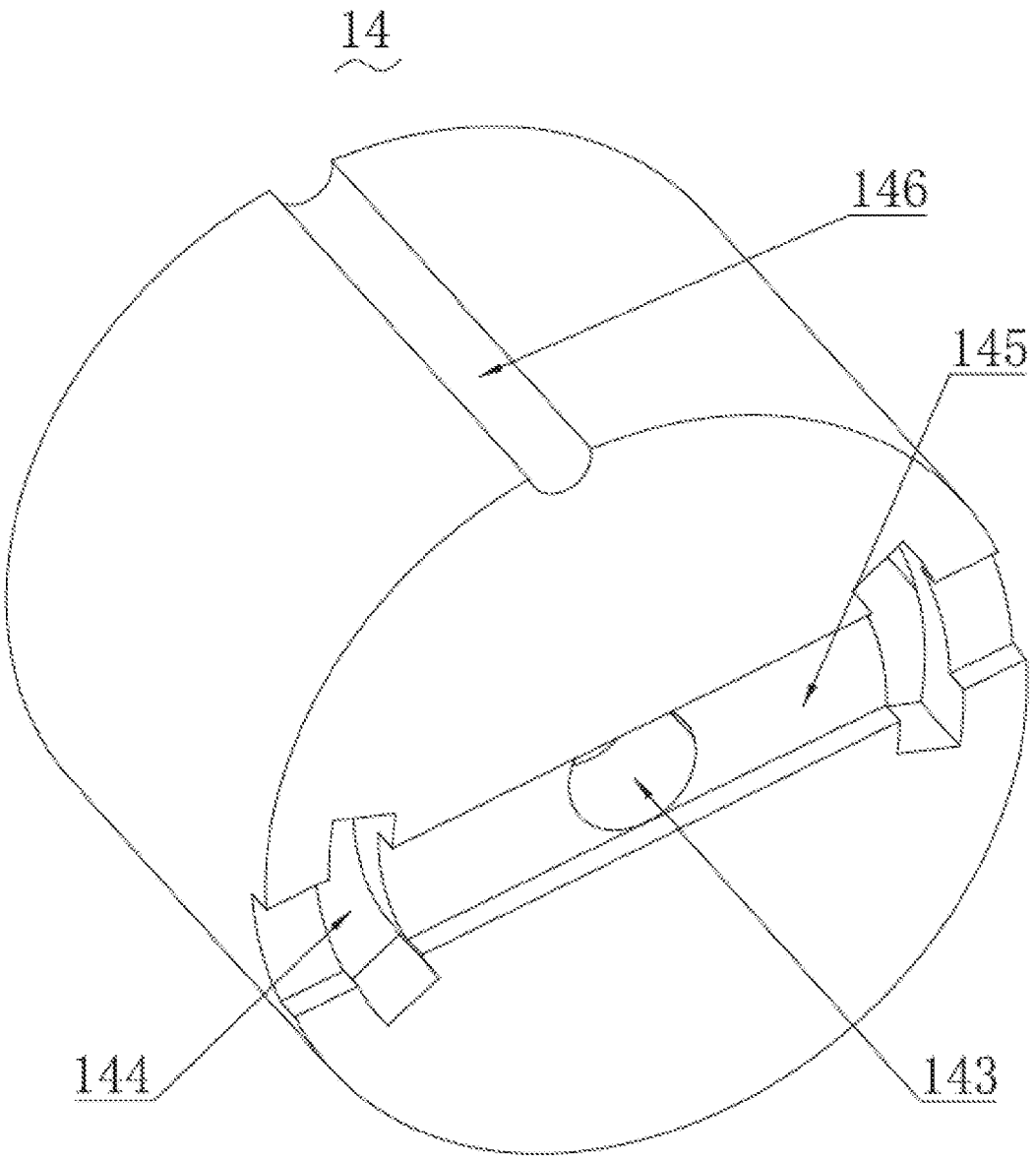
FIG. 3 is a perspective view of a cooling block of the present invention.

Referring to FIGS. 1, 2 and 3, wherein FIG. 1 is an exploded view of an atomizer 100 of the present invention; FIG. 2 is a cross-sectional view of the atomizer 100 of the present invention from a first perspective; and FIG. 3 is a perspective view of a cooling block 14 of the present invention.

The atomizer 100 of the present invention can atomize liquids such as essential oil, water, perfume, and smoke oil. The atomizer 100 comprises a liquid storage shell 11, an ultrasonic atomizing core 12, a liquid transporting cotton 13, a cooling block 14 and an end cap 15.

The liquid storage shell 11 surrounds a liquid storage cavity 113 and a functional cavity 115 which are isolated from each other, wherein the liquid storage cavity 113 is used for storing liquid, and the functional 115 is used for assembling atomizing parts as well as recycling large particle droplets generated by atomization.

The ultrasonic atomizing core 12 is assembled in the functional cavity 115, which uses high-frequency vibration (frequency is 1-5 MHz, such as 1.7 Mhz, 2.4 MHz and 3 MHz) to break up the liquid molecular structure to produce a naturally flowing mist.

The liquid transporting cotton 13 is connected to the ultrasonic atomizing core 12 and inserted into the liquid storage cavity 113, so as to transport the liquid in the liquid storage cavity 113 to the ultrasonic atomizing core 12. The liquid transporting cotton 13 relies on surface tension of the liquid and its own suction effect to transport the liquid to the middle of the ultrasonic atomizing core 12 in the hollow area of the liquid transporting cotton 13, and then the ultrasonic atomizing core 12 uses high-frequency vibration to atomizing the liquid.

The cooling block 14 is attached on one side of the ultrasonic atomizing core 12. The cooling block 14 has an atomizing hole 143 and an oil return hole 144. After the liquid is atomized, it is blown out from the atomizing hole 143, and heat of the ultrasonic atomizing core 12 is transported to the cooling block 14, thereby keeping the ultrasonic atomizing core 12 at a suitable working temperature, for example below 50 degrees Celsius, to maintain effective composition of the liquid, thereby increasing the service life of the ultrasonic atomizing core. A material of the cooling block 14 may be metal, such as gold, silver, aluminum, stainless steel, magnesium aluminum alloy and copper. The material of the cooling block 14 may also be made of non-metallic thermally conductive materials such as thermally conductive silicone. The function chamber 115 recovers the large particle droplets generated by atomization and returns them to the liquid transporting cotton 13 through the oil return hole 144.

The end cap 15 is connected to one end of the liquid storage shell 11 to seal the liquid storage cavity 113 and the functional cavity 115. The end cap 15 contacts with and fixes the cooling block 14 to ensure contact tightness between the cooling block 14 and the ultrasonic atomizing core 12. Furthermore, heat of the cooling block 14 can be transferred to the end cap 15, and the end cap 15 will diffuse the heat into the air, thereby accelerating the heat diffusion of the ultrasonic atomizing core 12. A material of the end cap 15 may be metal, such as gold, silver, aluminum, stainless steel, magnesium aluminum alloy and copper. The end cap 15 has a mist hole 153, wherein the liquid is discharged through the atomization hole 143 and the mist hole 153 in sequence after being atomized.

Preferably, a diameter of the atomizing hole is 1-5 mm, such as 1 mm, 2.5 mm, 2 mm, 3 mm, 4 mm and 5 mm. However, when the atomizing hole 143 is too large, a contact area of the cooling block 14 and the ultrasonic atomizing core 12 will be reduced, thereby reducing a cooling effect of the cooling block 14 on the ultrasonic atomizing core 12. When the atomizing hole 143 is too small, it will prevent the liquid from discharging after be atomized. The atomizing hole 143 may directly face a center of the ultrasonic atomizing core 12. Of course, the atomizing hole 143 may also face other positions of the ultrasonic atomizing core 12.

Preferably, a part of the liquid transporting cotton 13 is pressed between the cooling block 14 and the ultrasonic atomizing core 12 to prevent the liquid transporting cotton 13 from moving. Specifically, a side of the cooling block 14, which faces the ultrasonic atomizing core 12, has a limiting groove 145; the liquid transporting cotton 13 is placed in the limiting groove 145 and opposite ends of the liquid transporting cotton 13 are inserted into the liquid storage cavity 113, which forms a U-shaped self-bending structure; the liquid cotton 13 has a hollow area to avoid blocking the atomizing hole 143. The liquid in the liquid storage cavity 113 moves along the ends of the liquid transporting cotton 13 to the hollow area. The liquid transporting cotton 13 is placed on the ultrasonic atomizing core 12 and forms first fixing by its self-bending structure. In addition, the liquid transporting cotton 13 is pressed by the limiting groove 145 of the cooling block 14 to form second fixing. The first and second fixing completely prevents the liquid transporting cotton 13 from separating from the ultrasonic atomizing core 12 and slipping into the liquid storage cavity 113 during operation.

Figure 4:
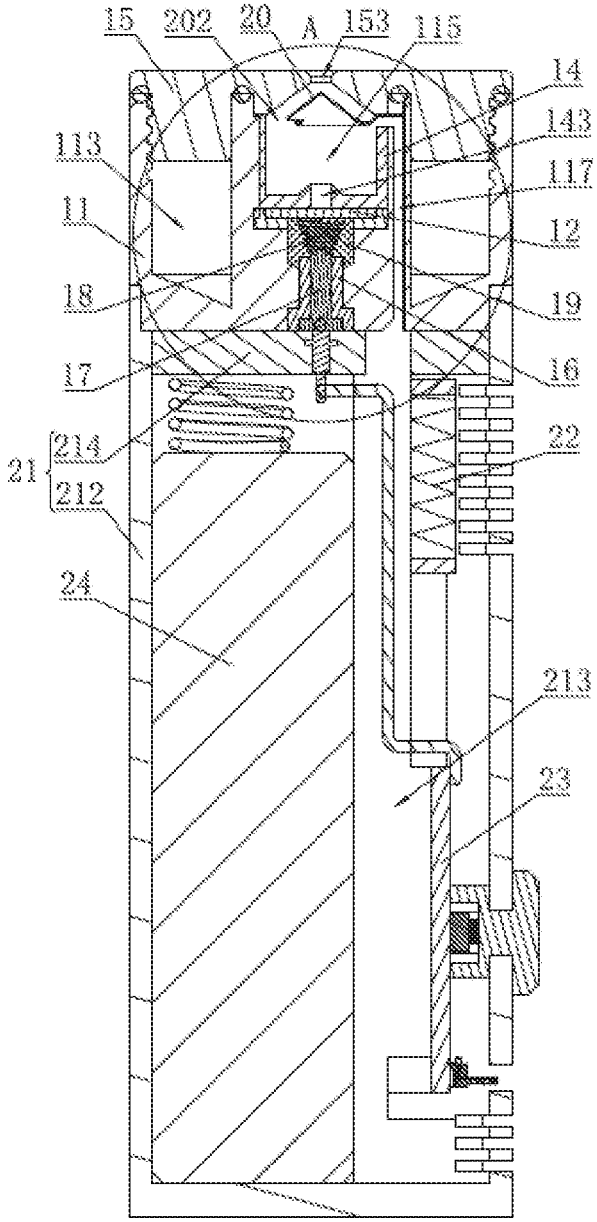
FIG. 4 is a cross-sectional view of the atomizer of the present invention from a second perspective.
Figure 5:
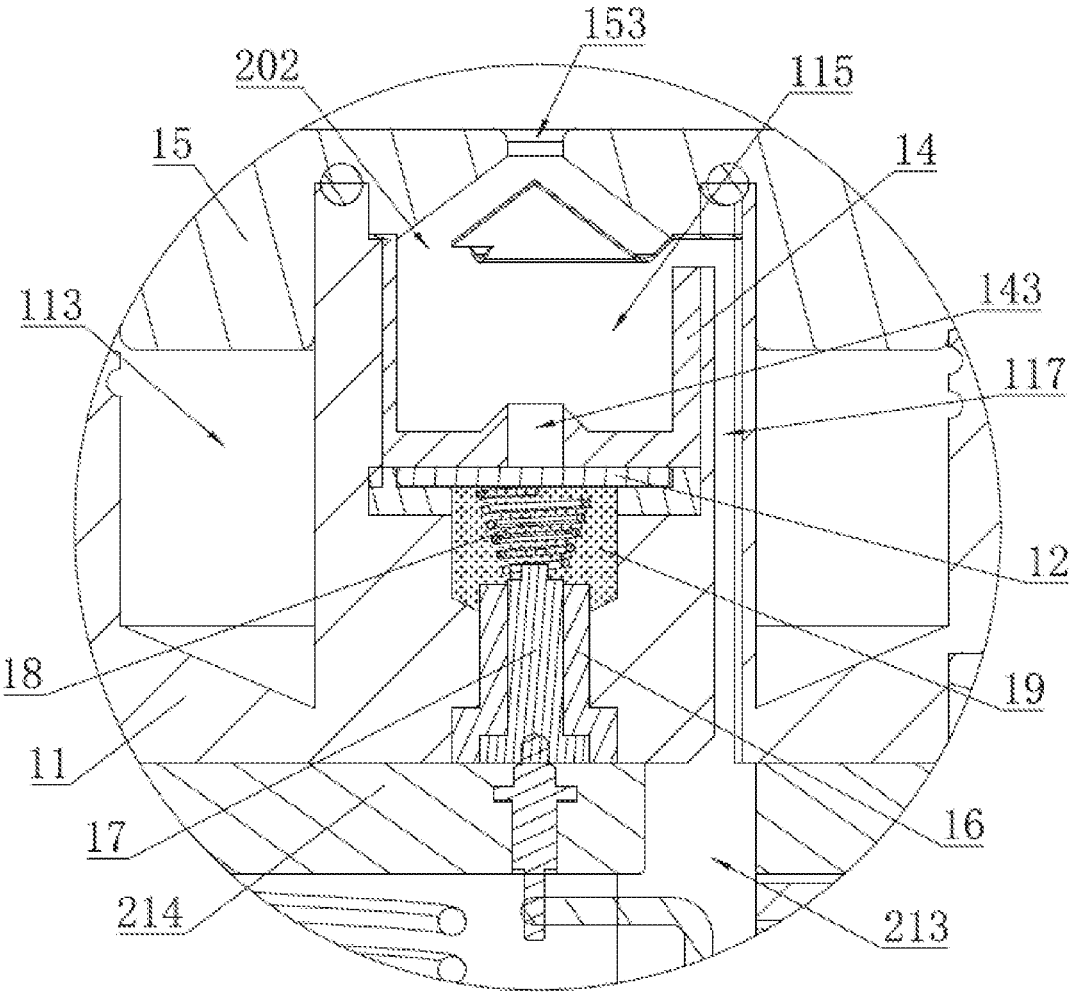
FIG. 5 is a partially enlarged view of an area A in FIG. 4 of the present invention.

Referring to FIGS. 1, 3, 4 and 5, wherein FIG. 4 is a cross-sectional view of the atomizer of the present invention from a second perspective; and FIG. 5 is a partially enlarged view of an area A in FIG. 4 of the present invention. The first perspective is perpendicular to the second perspective.

In one embodiment, a limiting rib is provided on an internal wall of the functional cavity 115, and a matching groove 146 is provided on the cooling block 14; the cooling block 14 contacts with the internal wall of the functional cavity 115, and the matching groove 146 cooperates with the limiting rib.

In another embodiment, a matching groove is provided on an internal wall of the functional cavity 115, and a limiting rib is provided on the cooling block 14; the cooling block 14 contacts with the internal wall of the functional cavity 115, and the matching groove cooperates with the limiting rib.

In the above two embodiments, the cooling block 14 contacts with the internal wall of the functional cavity 115, so that the heat of the cooling block 14 can be transferred to the liquid storage shell 11, and the liquid storage shell 11 transfers the heat to the air, thereby accelerating heat diffusion of the ultrasonic atomization sheet 12. A material of the liquid storage shell 11 may be metal, such as gold, silver, aluminum, stainless steel, magnesium aluminum alloy and copper. In addition, the matching groove and the limiting rib cooperate with each other to prevent the cooling block 14 from moving in the circumferential direction relative to the liquid storage shell 11, thereby ensuring that the liquid transporting cotton 13 will not separate from the ultrasonic atomizing core 12 due to movement of the cooling block 14.

Preferably, the atomizer 100 further comprises: a baffle 20, wherein the baffle 20 is pressed between the end cap 15 and the cooling block 14, and the baffle 20 has a notch 202; an orthographic projection of the notch 202 on the end cap 15 does not overlap with the mist hole 153, wherein after being atomized, the liquid is discharged through the atomizing hole 143, the notch 202 and the mist hole 153 in sequence. The baffle 20 allows the large particle liquid generated by atomization to fall back to the oil return hole 144 after being collected by the baffle 20, in such a manner that the large particle liquid returns to the liquid transporting cotton 13 and rejoins the atomization. As a result, the liquid is not wasted or accumulated. The orthographic projection of the notch 202 on the end cap 15 does not overlap with the mist hole 153 to avoid the large particles of mist produced the atomization from flying out, and also to prevent human eyes from observing the cooling block 14, the ultrasonic atomizer 12 and other parts from outside the atomizer 100.

Preferably, the atomizer 100 further comprises: an insulating sleeve 16, a conductive rod 17 and a conductive spring 18, wherein an end of the liquid storage shell 11, which is away from the end cap 15, has a conductive channel communicating with the functional cavity 115; the insulating sleeve 16 is under an interference fit state in the conductive channel; the conductive rod 17 passes through the insulating sleeve 16 and is connected to the conductive spring 18, and the conductive spring 18 is further connected to the ultrasonic atomizing core 12. Power is transferred to the ultrasonic atomizing core 12 through the conductive rod 17 and the conductive spring 18 in sequence, and the conductive spring 18 is elastic, so that when the ultrasonic atomizing core 12 is subjected to high-frequency oscillation, the conductive spring 18 can continuously contact with the ultrasonic atomizing core 12 to maintain the circuit on. The atomizer 100 further comprises a thermally conductive silicone grease 19. The conductive channel is enclosed into a sealed cavity by the ultrasonic atomizing core 12, the insulating sleeve 16 and the conductive rod 17, and the thermally conductive silicone grease 19 is filled between the ultrasonic atomizing core 12 and the conductive rod 17. The heat of the ultrasonic atomizing core 12 is absorbed by the thermally conductive silicone grease 19 and is transferred to the liquid storage shell 11, the conductive rod 17, and other components.

The atomizer 100 further comprises: an auxiliary shell assembly 21 and a fan 22, wherein the auxiliary shell assembly 21 can be used for auxiliary installation of accessories such as a battery 24, the fan 22, a control unit, a transformer module, and the like. The liquid storage shell 11 has a first air duct 117 communicating with the functional cavity 115; the auxiliary shell assembly 21 is connected to the liquid storage shell 11 to be integrated, and has a second air duct 213 communicating with the first air duct 117; the fan 22 is assembled in the auxiliary shell assembly 21 and faces the second air duct 213, so as to accelerate air flow in the functional cavity 115. During operation, the fan 22 accelerates air in the second air duct 213, and the air in the second air duct 213 enters the first air duct 117 to accelerate air therein, then the air in the first air duct 117 enters the functional cavity 115 to accelerate air therein, and the air in the functional cavity 115 overflows from the mist hole 153 to accelerate the overflow of the atomized liquid.

The atomizer 100 further comprises: a circuit board 23, wherein the circuit board 23 is assembled in the auxiliary shell assembly 21; the second air duct 213 further extends to the circuit board 23, and the fan 22 is electrically connected to the circuit board 23, so as to accelerate air flow around the circuit board 23, thereby accelerating heat release of the circuit board 23 and maintaining the circuit board 23 at a normal working temperature range.

Surely, the atomizer 100 may further comprise: the battery 24, wherein the battery 24 is assembled in the auxiliary shell assembly 21; the second air duct 213 further extends to the battery 24, and the circuit board 23 is electrically connected to the battery 24, so as to accelerate air flow around the battery 24, thereby accelerating heat release of the battery 24 and maintaining the battery 24 at a normal working temperature range.

An end of the second air duct 213, which is away from the liquid storage shell 11, further penetrates the auxiliary shell assembly 21. As a result, air passing through the circuit board 23, the battery 24 and the like can be directly discharged through the second air duct 213 without passing through the first air duct 117.

Referring to FIGS. 1 and 2, the atomizer 100 further comprises: a magnet 25, wherein the magnet 25 is connected to the liquid storage shell 11 and magnetically connected to the auxiliary shell assembly 21; or the magnet 25 is connected to the auxiliary shell assembly 21 and magnetically connected to the liquid storage shell 11. That is to say, the auxiliary shell assembly 21 and the liquid storage shell 11 is detachably connected by a magnetic structure. Since the magnet 25 can be connected to another magnet 25, and the magnet 25 can also be connected to magnetic metals, embodiments of the above-mentioned magnetic connection will not be limited here. Any structure capable of achieving the magnetic connection is within the protection scope of the present invention.

Specifically, the auxiliary shell assembly 21 comprises a housing 212 and a top cover 214. The housing 212 has a receiving cavity for accommodating components such as the battery 24, the circuit board 23, and the fan 22. The top cover 214 is connected to the housing 212 to seal the receiving cavity. The connection may be achieved by screws. The screws are metal parts, so that the magnet 25 is magnetically connected to the screws.

According to the present invention, specific embodiments are used to explain the principles and implementations, which are only conducive to understanding the method and core ideas of the present invention. The above are only preferred embodiments of the present invention. It should be pointed out that due to the limitation of word expression and there are objectively unlimited specific structures, for those of ordinary skill in the art, without departing from the principles of the present invention, several improvements, polishing or changes can also be made, and the above technical features can also be combined in an appropriate manner. These improvements, polishing, changes or combinations, or unmodified inventive concepts and technical solutions directly applied to other occasions, are all within the protection scope of the present invention.

What is claimed is:

1. An atomizer, comprising:

a liquid storage shell surrounding a liquid storage cavity and a functional cavity which are isolated from each other, wherein the liquid storage cavity is used for storing liquid;

an ultrasonic atomizing core assembled in the functional cavity;

a liquid transporting cotton connected to the ultrasonic atomizing core and inserted into the liquid storage cavity, so as to transport the liquid in the liquid storage cavity to the ultrasonic atomizing core;

a cooling block attached on one side of the ultrasonic atomizing core, wherein the cooling block has an atomizing hole and an oil return hole; and an end cap connected to one end of the liquid storage shell to seal the liquid storage cavity and the functional cavity, wherein the end cap contacts with and fixes the cooling block, and the end cap has a mist hole;

wherein the liquid is discharged through the atomizing hole and the mist hole in sequence after being atomized.

2. The atomizer, as recited in claim 1, wherein a diameter of the atomizing hole is 1-5 mm.

3. The atomizer, as recited in claim 1, wherein a side of the cooling block, which faces the ultrasonic atomizing core, has a limiting groove; the liquid transporting cotton is placed in the limiting groove and opposite ends of the liquid transporting cotton are inserted into the liquid storage cavity; the liquid cotton has a hollow area to avoid blocking the atomizing hole.

4. The atomizer, as recited in claim 1, wherein a limiting rib is provided on an internal wall of the functional cavity, and a matching groove is provided on the cooling block; the cooling block contacts with the internal wall of the functional cavity, and the matching groove cooperates with the limiting rib; or a matching groove is provided on an internal wall of the functional cavity, and a limiting rib is provided on the cooling block; the cooling block contacts with the internal wall of the functional cavity, and the matching groove cooperates with the limiting rib.

5. The atomizer, as recited in claim 1, further comprising: an insulating sleeve, a conductive rod, a conductive spring, and a thermally conductive silicone grease, wherein an end of the liquid storage shell, which is away from the end cap, has a conductive channel communicating with the functional cavity; the insulating sleeve is under an interference fit state in the conductive channel; the conductive rod passes through the insulating sleeve and is connected to the conductive spring, and the conductive spring is further connected to the ultrasonic atomizing core; the thermally conductive silicone grease is filled between the ultrasonic atomizing core and the conductive rod.

6. The atomizer, as recited in claim 1, further comprising: a baffle, wherein the baffle is pressed between the end cap and the cooling block, and the baffle has a notch; an orthographic projection of the notch on the end cap does not overlap with the mist hole.

7. The atomizer, as recited in claim 1, further comprising: an auxiliary shell assembly and a fan, wherein the liquid storage shell has a first air duct communicating with the functional cavity; the auxiliary shell assembly is connected to the liquid storage shell, and has a second air duct communicating with the first air duct; the fan is assembled in the auxiliary shell assembly and faces the second air duct, so as to accelerate air flow in the functional cavity.

8. The atomizer, as recited in claim 7, further comprising: a circuit board, wherein the circuit board is assembled in the auxiliary shell assembly; the second air duct further extends to the circuit board, and the fan is electrically connected to the circuit board, so as to accelerate air flow around the circuit board.

9. The atomizer, as recited in claim 8, wherein an end of the second air duct, which is away from the liquid storage shell, further penetrates the auxiliary shell assembly.

10. The atomizer, as recited in claim 7, wherein further comprising: a magnet, wherein the magnet is connected to the liquid storage shell and magnetically connected to the auxiliary shell assembly; or the magnet is connected to the auxiliary shell assembly and magnetically connected to the liquid storage shell.

* * * * *